United States Patent [19]

Striplin

[11] 4,203,180

[45] May 20, 1980

[54] HOLDER FOR VEGETABLES SUCH AS BROCCOLI

[76] Inventor: Charles D. Striplin, c/o Striplin Machine & Engineering Co., P.O. Box 515, Benicia, Calif. 94510

[21] Appl. No.: 19,106

[22] Filed: Mar. 9, 1979

[51] Int. Cl.[2] ..... B65D 67/02

[52] U.S. Cl. ..... 24/17 B; 206/526; 229/1.5 H

[58] Field of Search ..... 206/526; 229/1.5 H; 24/30.5 S, 17 B, 17 R

[56] References Cited

U.S. PATENT DOCUMENTS

| | | | |
|---|---|---|---|
| 811,742 | 2/1906 | Petrie | 229/1.5 H |
| 2,070,414 | 2/1937 | Snell | 229/1.5 H |
| 3,073,063 | 1/1963 | Schumm | 24/30.5 S |
| 3,775,810 | 12/1973 | Smith, Jr. et al. | 24/30.5 S |

*Primary Examiner*—William T. Dixson, Jr.

[57] ABSTRACT

A holder for vegetables having a stalk, such as broccoli, is provided in a form of a thin truncated cone wherein the small end has been divided into a plurality of flexible fingers. The fingers engage the stalks of the vegetables so that they present an attractive appearance when offered for sale.

6 Claims, 9 Drawing Figures

HOLDER FOR VEGETABLES SUCH AS BROCCOLI

SUMMARY OF THE INVENTION

Many vegetables having stalks, particularly such vegetables as celery, cauliflower, broccoli, onions, leeks and the like, are ordinarily sold as bunches containing two or more of the vegetables. In the past, it has been universal practice to tie up two or more of the vegetables into salable units, utilizing for this purpose various tying elements such as string, rubber bands, and twistable plastic-encased wires.

These methods have not been fully satisfactory. For instance, if the tying element does not have a degree of flexibility, the vegetables frequently dry out in storage or while they are being offered for sale so that the tying element becomes loose.

The problem is particularly severe when only two stalks of a vegetable are tied together. Three or more stalks will lie parallel to each other so that one can tie the stalks with a flexible member such as a rubber band, and there will be no great tendency of the stalks to twist. However, no such condition of stability exists when only two stalks are used since if the two stalks are tied, even with a flexible element such as a rubber band, there will still be a tendency for the stalks to twist. As some of the vegetables come with relatively large heads, such as broccoli, it is highly desirable that one be able to tie a bunch containing only two stalks which heretofore has not been practical.

In accordance with the present invention, a holder is provided for holding a plurality of vegetable stalks together which is in the form of a truncated conical element. The small end of the device is divided into a number of thin, flexible fingers, preferably wedge-shaped at the tip, so that they will lie parallel along the stalk of a vegetable and engage the stalks throughout their circumference. The tips tend to dig into the stalk, holding it firmly.

Thus, even if only two stalks are employed in making up a salable unit or bunch of the vegetable, the vegetable will be securely held. There will be a no tendency for twisting so that the vegetables will have a neat, saleable appearance.

Because the fingers are flexible and have a spring action, even should the vegetables dry out to some extent during handling and storage, reducing the diameter, they nevertheless will be held together in a firm, neat package.

The holder of the present invention is made of an inert flexible plastic, preferably of a polyolefin such as polypropylene.

The device of the present invention is easy to mold and does not require that the mold have any moving parts. Accordingly, the structure is quite inexpensive, lending itself to one-time use.

Various other features and advantages of the invention will be brought forth in the balance of the specification.

DESCRIPTION OF THE PREFERRED EMBODIMENTS

Figure 1:
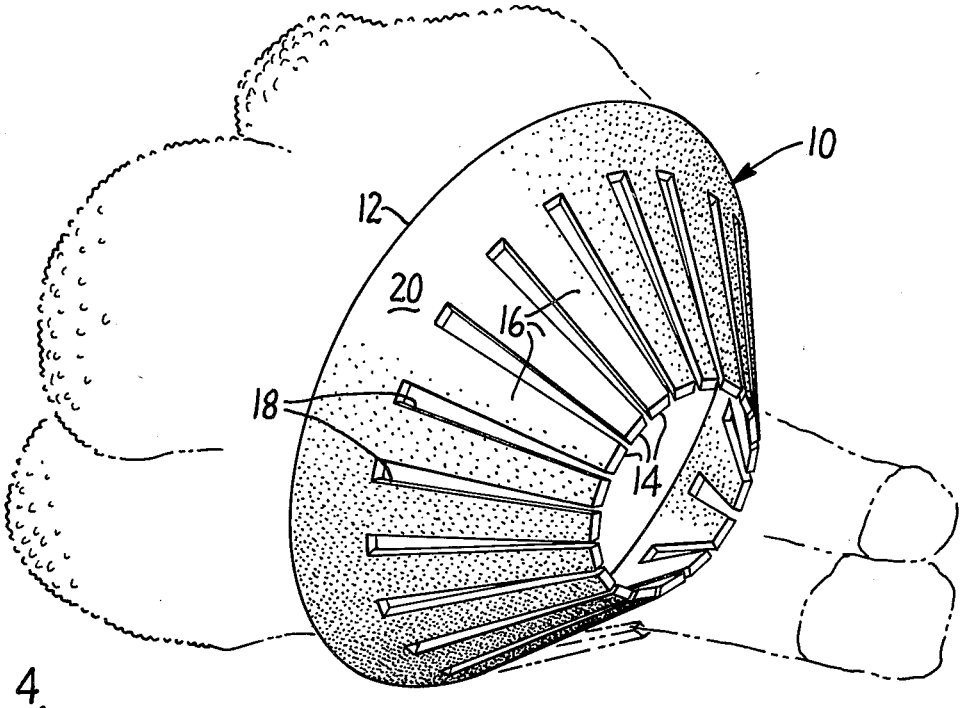
FIG. 1 is a perspective view of a device embodying the present invention.

Referring now to the drawings by reference characters, the device of the present invention is generally designated 10. It is made of a plastic which is non-toxic so that it will not contaminate vegetables or other produce. It is thin and flexible so that it will conform to the shape of an article as is later explained in detail. Polyolefins are suitable for this purpose, although the present invention is not limited to the use of any particular plastic.

Figure 2:
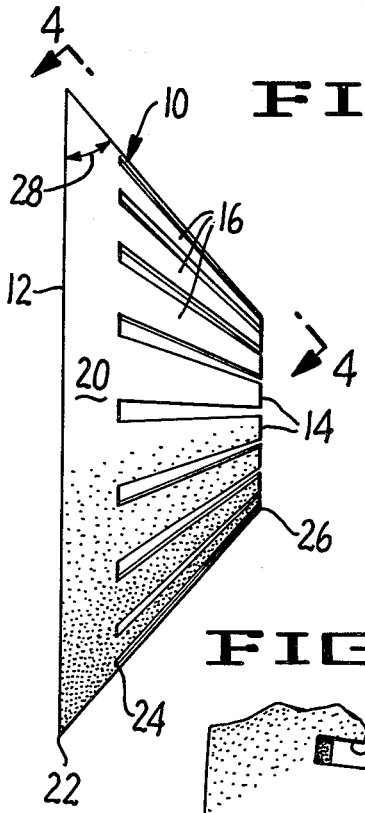
FIG. 2 is a side view of the structure shown in FIG. 1.
Figure 3:
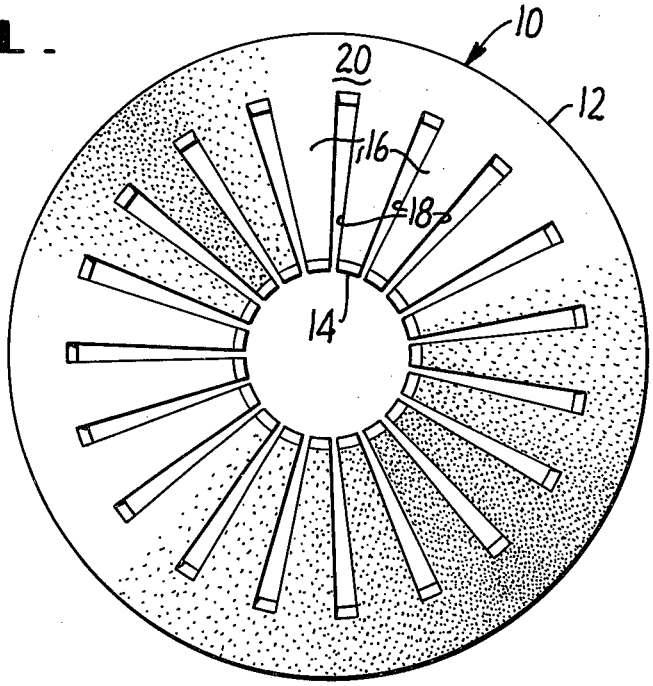
FIG. 3 is an end view of the structure shown in FIG. 1.
Figure 4:
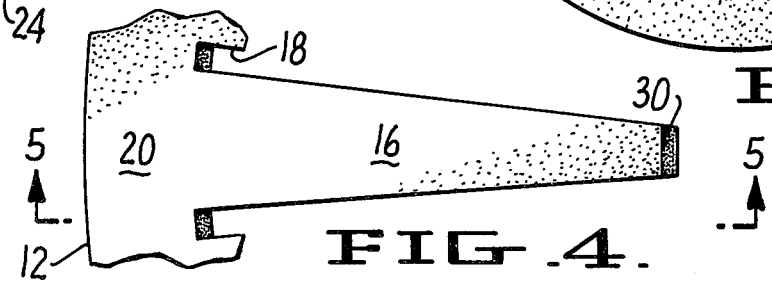
FIG. 4 is a section on the line 4—4 of FIG. 2.

The holder 10 is in the form of a truncated cone or frustrum and extends from a circular base 12 to a top circular portion 14. The walls forming the truncated cone are thin, flexible and spring-like. In the embodiment shown, the wall is divided into nineteen fingers 16 by means of the slots 18. This leaves a solid rim 20, which forms the base of the fingers. In a practical embodiment of the invention, the width of the solid rim 10, i.e. the distance between 22 and 24 in FIG. 2 was about one centimeter, while the length of the fingers, i.e. the distance between 24 and 26 in FIG. 2 was about 4 centimeters. Thus, the fingers take up about four-fifths of the wall of the truncated cone. The angle of the cone is such that the angle between the wall and the base, i.e. angle 28 in FIG. 2, is roughly 45 degrees but is not limited to this angle. In the embodiment of the invention shown, there are 19 of the fingers 16 and, although this exact number is not critical, there should be at least 16 fingers in order to properly engage vegetables as is hereinafter described in detail.

Figure 5:
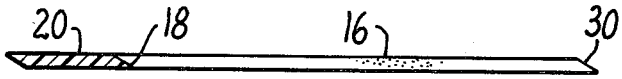
FIG. 5 is a section on the line 5—5 of FIG. 4.

The tips of the fingers, as is best seen in FIG. 5, are preferably wedge-shaped as is shown at 30. This gives the fingers a slight tendency to dig in and engage the stalks firmly.

Figure 6:
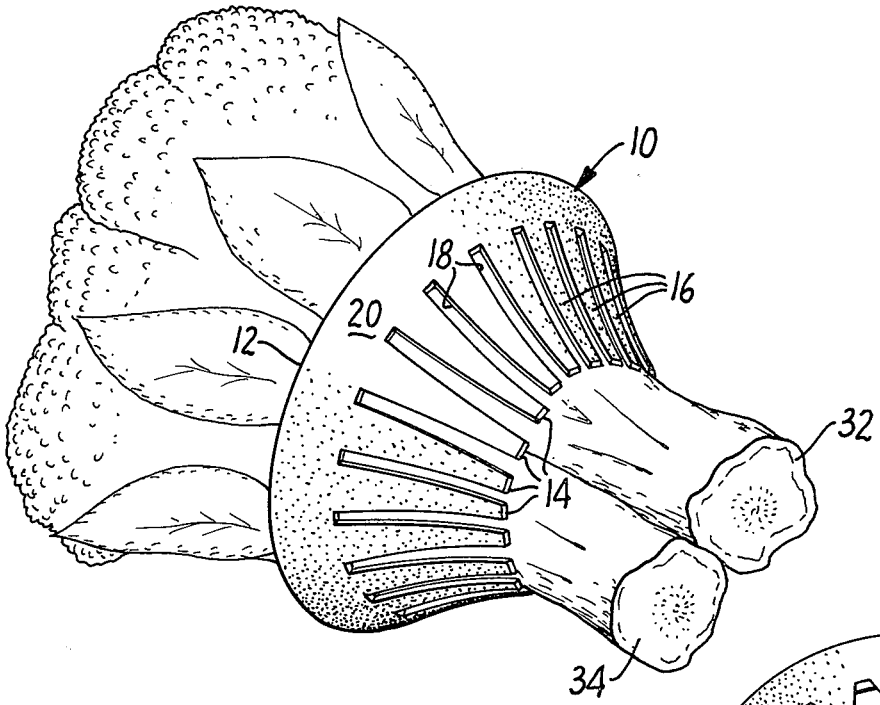
FIG. 6 is a perspective view of a device embodying the present invention showing it engaging two stalks of broccoli.
Figure 8:
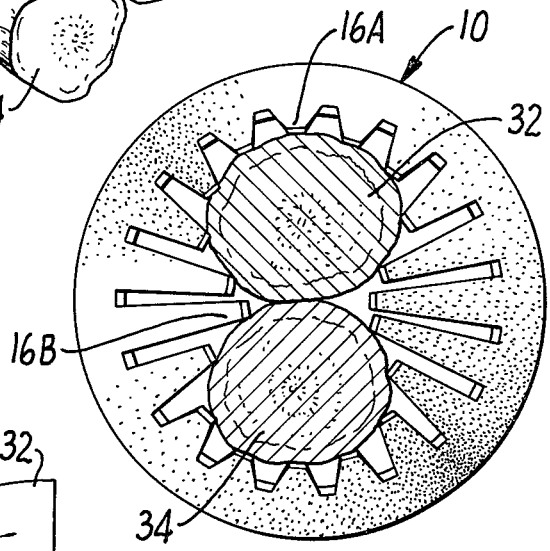
FIG. 8 is an end view of the subject matter of FIG. 6.
Figure 7:
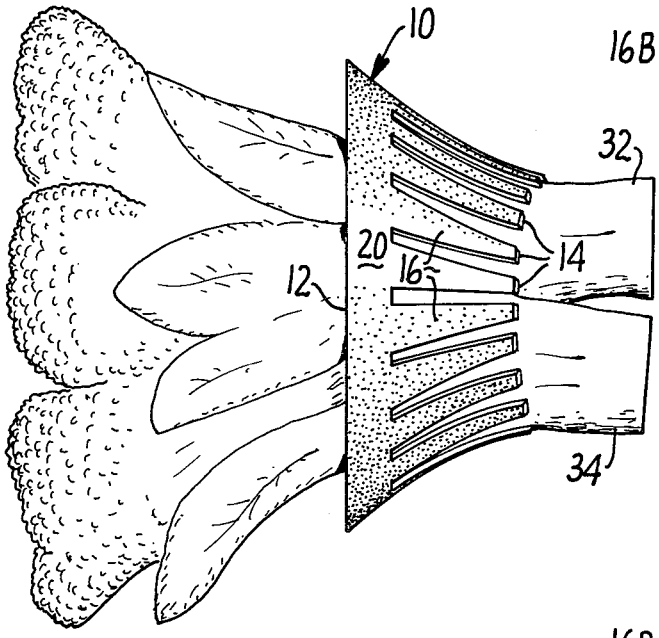
FIG. 7 is a side view of the subject matter of FIG. 6.
Figure 9:
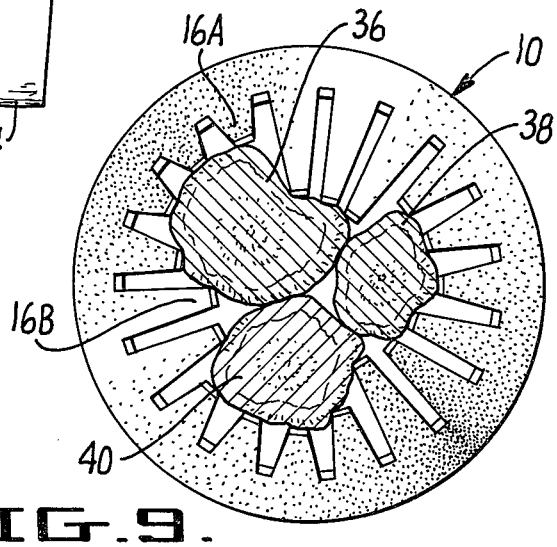
FIG. 9 is an end view showing the structure of the present invention engaging three stalks of broccoli.

In FIGS. 6, 7 and 8, a holder embodying the present invention is shown engaging two stalks of broccoli 32 and 34. It will be seen that the fingers lie along the stalk and engage the stalks even though the stalks themselves are quite irregular. Thus, at the greatest diameter, for example the finger shown as 16A, the finger is highly flexed; while at points of lesser diameter, such as the finger shown at 16B, the finger is less flexed and occupies the space between the two adjacent stalks. Similarly, when three stalks are used, such as the stalks 36, 38, and 40 of FIG. 9, the fingers will flex and will engage the stalks despite the irregular nature of the stalks.

As was pointed out previously, the device of the present invention firmly engages the stalks and is particularly useful when a package of only two stalks is employed which would normally have a tendency to twist. As the vegetable dries out in storage, the spring-like flexible fingers maintain pressure on it, so that even if the size of the stalk considerably decreases through dehydration, it is nevertheless still firmly engaged.

Once the device of the present invention is engaged on a plurality of stalks, it is almost impossible to dislodge it, and it is difficult or impossible to turn it wrong side out. In fact, the most practical way of releasing the vegetables is for the housewife to snip the holder with kitchen shears.

Various other features and advantages of the invention will be apparent to those skilled in the art.

I claim:

1. A holder for vegetables or the like, comprising a structure having in its unstressed condition a relatively thin side wall in the form of a truncated cone and with the side wall divided into a plurality of inward-sloping flexible fingers leading from a solid base of the cone to the terminal ends of the fingers whereby said structure can be forced over an irregular article and the fingers will conform to the shape of the irregular article and hold the same.

2. The holder of claim 1 wherein the cone has an angle of about 45°.

3. The holder of claim 1 wherein the fingers are about 4 times as long as the solid base.

4. The holder of claim 1 wherein the tips of the fingers are wedge-shaped with the tip adapted to engage the stalk of a vegetable.

5. The holder of claim 1 constructed of a flexible plastic.

6. The structure of claim 1 having from 16 to 19 fingers.

* * * * *